US012623824B2

(12) United States Patent
Somaya

(10) Patent No.: US 12,623,824 B2
(45) Date of Patent: May 12, 2026

(54) SHOT DROPPER

(71) Applicant: Vishva Somaya, Irving, TX (US)

(72) Inventor: Vishva Somaya, Irving, TX (US)

( * ) Notice: Subject to any disclaimer, the term of this patent is extended or adjusted under 35 U.S.C. 154(b) by 3 days.

(21) Appl. No.: 18/661,649

(22) Filed: May 12, 2024

(65) Prior Publication Data

US 2025/0346418 A1 Nov. 13, 2025

(51) Int. Cl.
*B65D 67/02* (2006.01)
*A47G 19/23* (2006.01)

(52) U.S. Cl.
CPC ..... *B65D 67/02* (2013.01); *A47G 19/23* (2013.01)

(58) Field of Classification Search
CPC .... B65D 25/22; B65D 67/02; B65D 81/3205; A47G 19/23; A47G 19/22; F16B 2/20; F16B 2/22; F16B 2/26; F16B 2/245; F16B 2/246; Y10T 24/29
USPC ..... 248/229.16, 229.26, 231.81; 220/729, 220/751; 24/288
See application file for complete search history.

(56) References Cited

U.S. PATENT DOCUMENTS 2,508,947 A * 5/1950 Hoke ..... A47L 13/58 248/312.1
2,840,879 A * 7/1958 Boice ..... F16B 5/06 24/570
3,231,076 A * 1/1966 Freiman ..... B65D 67/02 24/336
4,591,285 A * 5/1986 Nelson ..... F16L 3/13 403/11
4,778,210 A * 10/1988 Paulson ..... B65D 67/02 206/427
5,979,023 A * 11/1999 Nutto ..... B65D 67/02 24/339
D720,573 S * 1/2015 Pola ..... D7/396.2
9,119,490 B1 * 9/2015 Parodi, Jr. ..... A47G 19/22
D763,628 S * 8/2016 Griffin ..... D7/620
D771,443 S * 11/2016 Griffin ..... D7/619.1
9,949,558 B2 * 4/2018 Reed ..... A45F 5/06
10,281,061 B2 * 5/2019 Atragene ..... F16L 3/13
10,587,220 B2 * 3/2020 De Vogel ..... H02S 40/30
10,851,818 B2 * 12/2020 Chi Man ..... F16B 2/22
2006/0040020 A1 * 2/2006 Maric ..... A23G 1/50 426/104
2007/0205199 A1 * 9/2007 Wothers ..... B65D 1/265 362/101
2016/0058168 A1 * 3/2016 Reed ..... A45F 5/06 24/3.12
2017/0164722 A1 * 6/2017 Kunreuther ..... B65D 67/02
2020/0232490 A1 * 7/2020 Yamada ..... F16B 2/22

* cited by examiner

*Primary Examiner* — Jason W San
*Assistant Examiner* — Louis A Mercado
(74) *Attorney, Agent, or Firm* — Sam Pierce

(57) ABSTRACT

A clip which securely connects a smaller drinking vessel such as a shot glass on the inside rim of a larger drinking vessel such as a beer glass. A first holding finger and a second holding finger are configured for pinching a smaller drinking vessel between them. A third holding finger is configured for holding a larger drinking vessel. An arch connects the holding fingers.

5 Claims, 2 Drawing Sheets

SHOT DROPPER

BACKGROUND

Jager bombs and sake bombs are drink made by pouring sake into a shot glass and dropping it into a glass of beer. A shot glass is filled with one type of alcohol, or mixture thereof, and a larger glass (e.g., such as a pilsner glass) is filled (typically, in-part) with either an alcoholic or non-alcoholic drink. Thereafter, the shot glass is dropped into the larger glass by which the contents of the shot glass and the larger glass mix. Other similar types of drinks are also known.

Placing a shot glass inside of a larger glass is often a difficult and messy endeavor and the prior art has attempted to define devices, systems, and methods to make it less so.

In US20070205199, for example, the disclosed invention relates to a shot glass having a handle extending from the shot glass provided so that the shot glass can be lowered into a drinking vessel such as a beer glass having a larger volume than the shot glass. This is one solution to the above-described problem.

However, when the person drinking the beverage "rights" the larger vessel to a vertical position (sometimes quickly or suddenly in reaction to the falling or sliding shot glass), the shot glass falls or slides in an unpredictable and potentially undesirable direction which has the potential of causing impacts the bottom of the larger vessel and causing breakage to one or the other (or both).

SUMMARY OF INVENTION

A secure attachment mechanism between a shot glass and a beer glass continues to be a long-felt need in the art. Thus, the present invention is a clip which securely connects a smaller drinking vessel such as a shot glass on the inside rim of a larger drinking vessel such as a beer glass.

Therefore, according to an aspect of the present invention, there is provided a clip for holding a smaller drinking vessel inside of a larger drinking vessel, comprising: a first holding finger and a second holding finger configured for pinching a smaller drinking vessel between them; a third holding finger for holding a larger drinking vessel; and an arch connecting the holding fingers.

Another aspect of the present invention is a handle which is parabolic in shape and sits above the arch. Another aspect is a back connecting the handle and the arch.

DETAILED DESCRIPTION

Embodiments of the present invention will be described in accordance with the appended drawings.

Figure 1:
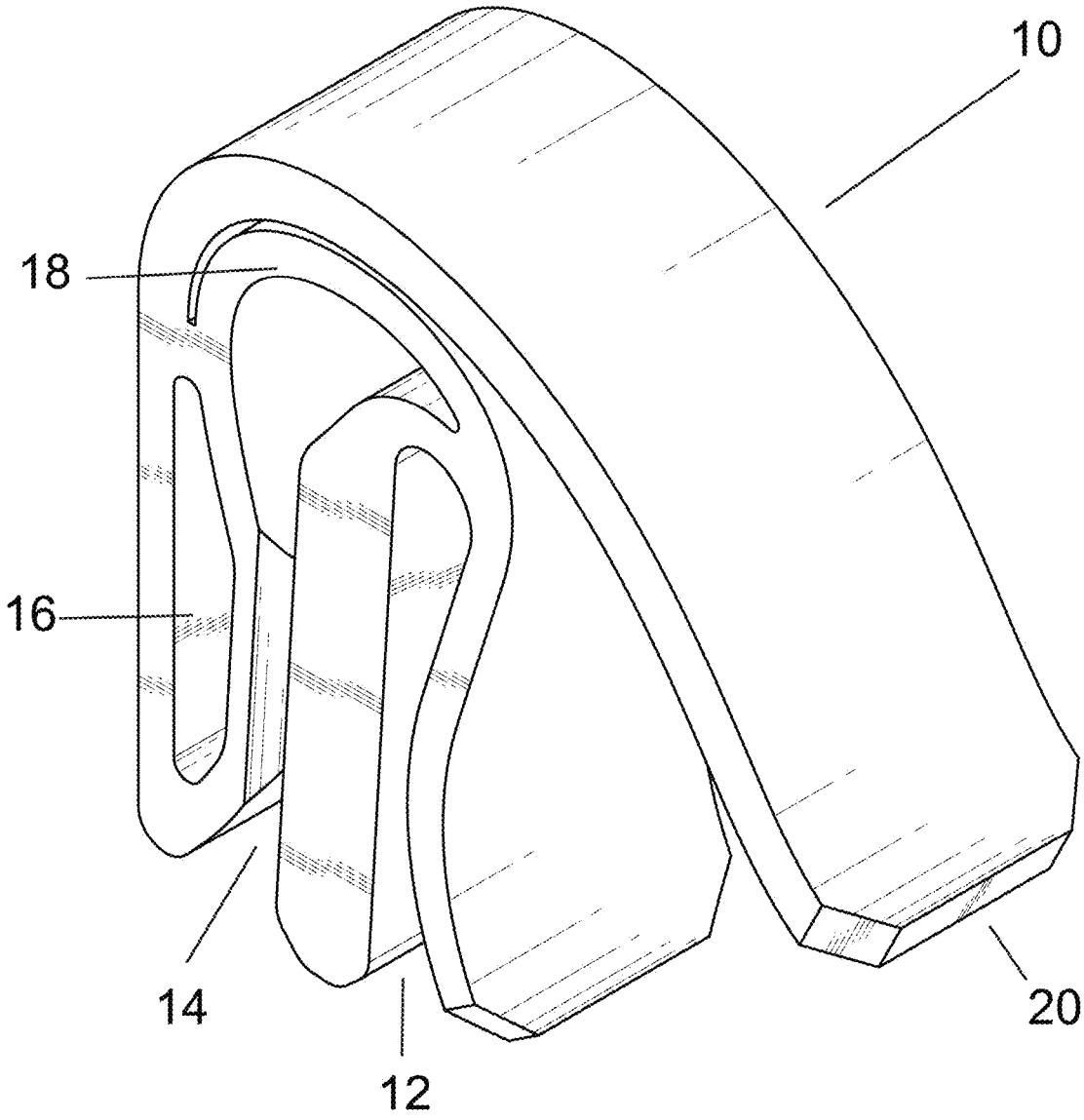
FIG. 1 illustrates a perspective view of the device for holding a shot glass according to an embodiment of the present invention.

FIG. 1 illustrates a perspective view of the device for holding a shot glass according to an embodiment of the present invention.

Clip 10 is a clip which securely attaches a smaller vessel, e.g., a shot glass on the inside wall of a vessel with a larger volume than the shot glass, e.g., a beer glass.

Clip 10 has a handle 20 on one of its ends which makes it easier to transport clip 10. Handle 20, which can be used as a handle, has a different main purpose. Handle 20 is the actuator to allow the shot glass to drop. Handle/Actuator 20 moved parts (28, 16, 26) off of the straight wall 22 and releases the shotglass into the larger glass.

Clip 10 has inlet 14 where the user clips the shotglass, and inlet 12 is where the user clips the larger glass. That's how the shotglass sits inside the larger glass.

Arch 18 connects the first inlet 12 and the second inlet 14. Cavity 16, is a cavity in the product itself. When both glasses are clipped, cavity 16 would essentially be sitting inside the shotglass. Cavity 16 may or may not exist in the embodiments as embodiments may be solid.

Figure 2:
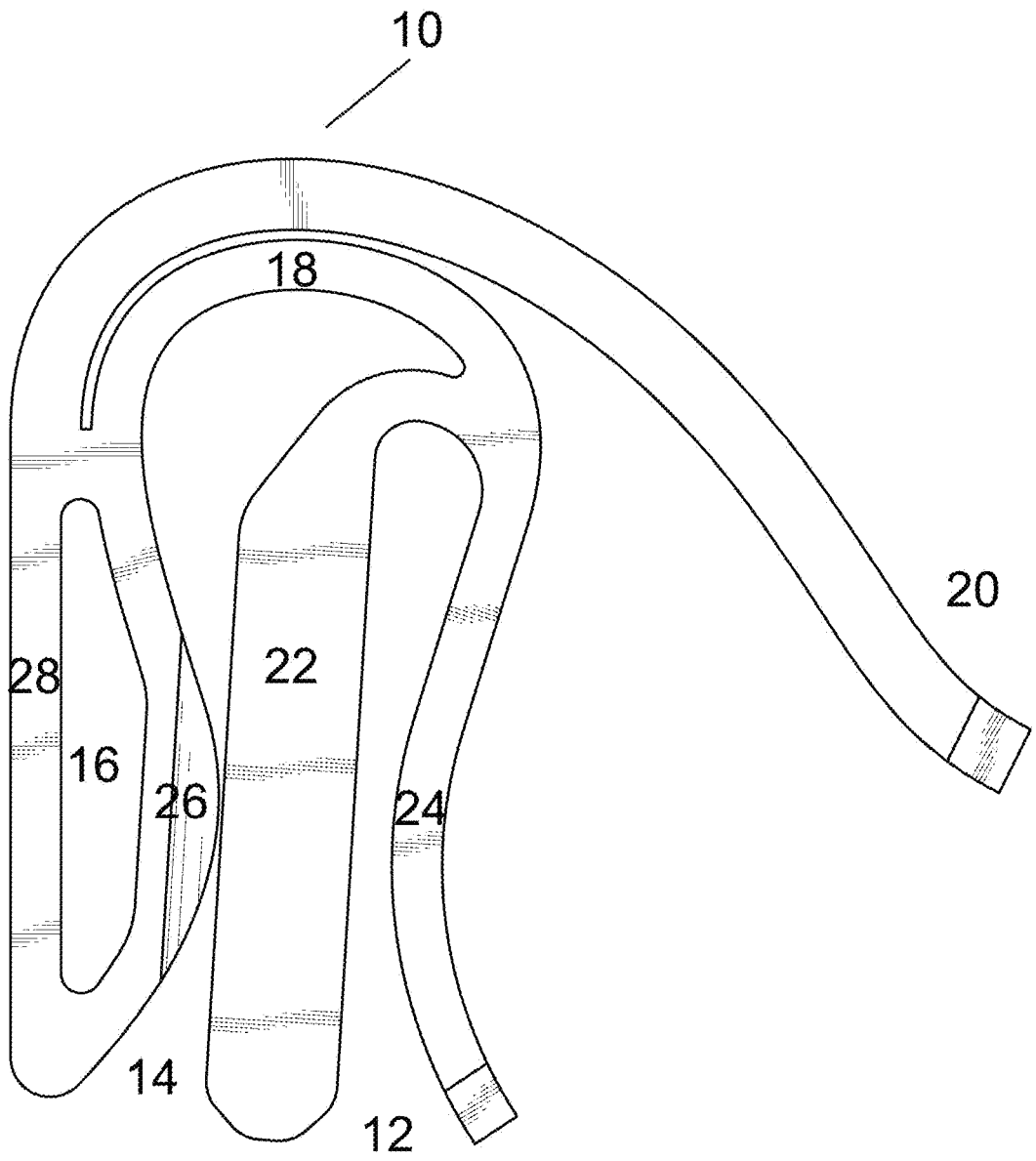
FIG. 2 illustrates a side view of the device for holding a shot glass according to an embodiment of the present invention.

FIG. 2 illustrates a side view of the device for holding a shot glass according to an embodiment of the present invention.

The handle on the end of clip 10 is on the side of the clip which is closer to the first inlet 12 for the beer glass than the second inlet 14 for receiving a shot glass.

Arch 18 which connects the first inlet 12 and the second inlet 14 is the source of curved beerglass holding finger 24 and straight shotglass holding finger 22. Curved beerglass holding finger 24 pinches a beer glass rim against straight shotglass holding finger 22 to hold the shot glass securely.

Extending shotglass holding finger 26 pinches a shot glass rim against straight shotglass holding finger 22 to hold the shot glass securely. On the other side of cavity 16 is back 28 which connects to handle 20. Handle 20 is the actuator to allow the shot glass to drop. Handle/Actuator 20 moves parts (28, 16, 26) off of the straight wall 22 and releases the shotglass into the larger glass.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description.

Other embodiments may be utilized and derived from the present invention, such that structural and logical substitutions and changes may be made without departing from the scope of this disclosure.

Accordingly, the specification and drawings are to be regarded in an illustrative rather than a restrictive sense. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments.

Combinations of the above embodiments, and other embodiments not specifically described herein, will be apparent to those of skill in the art upon reviewing the above description. Therefore, it is intended that the disclosure not be limited to the particular embodiment(s) disclosed.

Once given the above disclosure, many other features, modifications, and improvements will become apparent to the skilled artisan. Such other features, modifications, and improvements are therefore considered to be part of the present invention, the scope of which is to be determined by the following claims.

What is claimed is:

1. A clip for holding a shot glass inside of a larger glass, comprising:

a back;

a protrusion connected to the back extending inwardly;

a parabolic handle extending from the back first in an upward sloping direction then in a downward sloping direction;

a first inlet configured to clip the larger glass, and a second inlet configured to clip the shot glass;

an arch extending from the protrusion, wherein the arch which connects and extends between the first inlet and the second inlet is a source of a curved beerglass holding finger and a straight shotglass holding finger, and the curved beerglass holding finger is configured to pinch a beer glass rim against the straight shotglass holding finger, and the protrusion and the straight shotglass holding finger is configured to hold the shot glass securely;

wherein the handle is an actuator configured to allow the shot glass to drop, wherein the handle is configured to move the protrusion outwardly off of the straight shotglass holding finger and release the shot glass into the larger glass;

wherein when both of the glasses are clipped, the protrusion is configured to essentially be sitting inside the shot glass; and wherein the handle is on a side of the clip which is closer to the first inlet for the larger glass than the second inlet for receiving the shot glass.

2. A clip for holding a smaller drinking vessel inside a larger drinking vessel, comprising:

a back;

a protrusion extending inwardly from the back;

a handle extending from the back;

an arch extending from the protrusion;

a straight holding finger extending from the arch;

a curved holding finger extending from the arch;

wherein the straight holding finger and the curved holding finger define a first inlet configured to receive and pinch a rim of the larger drinking vessel;

wherein the protrusion and the straight holding finger define a second inlet configured to receive and pinch a rim of the smaller drinking vessel such that the smaller drinking vessel is retained within the larger drinking vessel; and wherein the handle is operatively coupled to the back such that movement of the handle causes the back and the protrusion to move away from the straight holding finger, thereby releasing the smaller drinking vessel from the second inlet into the larger drinking vessel.

3. The clip of claim 2, wherein when both the larger drinking vessel and the smaller drinking vessel are retained, the protrusion is positioned at least partially within the smaller drinking vessel.

4. The clip of claim 2, wherein the handle is positioned on a side of the clip closer to the first inlet configured to receive the larger drinking vessel than to the second inlet configured to receive the smaller drinking vessel.

5. The clip of claim 2, wherein the handle includes a curved profile that extends upwardly and then downwardly relative to the back.

* * * * *